US005253492A

United States Patent [19]

Mitsumoto

[11] Patent Number: 5,253,492

[45] Date of Patent: Oct. 19, 1993

[54] METHOD OF KNITTING IN PLEATS AND KNITTED TEXTURE HAVING KNITTED PLEATS

[75] Inventor: Shigenobu Mitsumoto, Wakayama, Japan

[73] Assignee: Shima Seiki Mfg., Ltd., Wakayama, Japan

[21] Appl. No.: 691,261

[22] Filed: Apr. 25, 1991

[30] Foreign Application Priority Data

May 2, 1990 [JP] Japan ..... 2-116636

[51] Int. Cl.[5] ..... D04B 7/24

[52] U.S. Cl. ..... 66/69; 66/176; 66/177

[58] Field of Search ..... 66/177, 64, 193, 145, 66/69, 70, 26, 176, 60 R, 73, 67, 76

[56] References Cited

U.S. PATENT DOCUMENTS 4,722,202 2/1988 Imboden ..... 66/177
4,888,964 12/1989 Klinge ..... 66/177
5,052,058 10/1991 Mueller ..... 66/177 X

FOREIGN PATENT DOCUMENTS 57-35038 2/1982 Japan .

*Primary Examiner*—Clifford D. Crowder

*Assistant Examiner*—Larry D. Worrell

*Attorney, Agent, or Firm*—Edwin E. Greigg; Ronald E. Greigg

[57] ABSTRACT

A method of knitting in pleats according to the present invention comprises the steps of: knitting a succession of surf ace knitted sections, fold-back knitted sections, and overlap knitted sections with the use of arrays of knitting needles mounted on at least a pair of front and rear needle beds, one or both of which are arranged movable leftward and rightward; removing the fold-back knitted sections from the corresponding needles after fastening of thread ends; displacing the surface knitted section and/or the overlap knitted section close to the needles, from which the fold-back knitted sections are removed, so that they are located next to each other; loading a succession of the surface, overlap, and surface knitted sections onto the array of needles on one of the two needle beds; after moving the other needle bed in a direction opposite to the fold-back direction of the bold-back section, loading the overlap or surface knitted section onto the knitting needles of the other needle bed; after moving the other needle bed in the knitting direction of the fold-back knitted section, overlapping the overlap section with the surface section through stitch shifting; and binding the overlapped regions in pleats.

3 Claims, 4 Drawing Sheets

METHOD OF KNITTING IN PLEATS AND KNITTED TEXTURE HAVING KNITTED PLEATS

BACKGROUND OF THE INVENTION

The present invention relates to a method of knitting in pleats, e.g. forming pleats in the waist or hem region of a knitwear such as a one-piece garment or a skirt, and a knitted texture having knitted pleats.

It is known that each of the pleats, e.g. box pleats arranged in the hem of a one-piece garment or a skirt, is formed by sewing a knitted fragment, which constitutes fold-back sections and an overlap section of the box pleat, into the slit of a surface knitted base, where the box pleat is arranged, and fabricated with the same material as of the fragment.

However, the disadvantage is that as the knitted fragment attached to the slit and the surface knitted base are fabricated separately, the process of knitting is doubled and takes a considerable length of time and also, the sewing of the fragment onto the base requires a cost of labor and time.

More particularly, the assignment of corresponding stitches on the knitted base for matching the fragment with the slit has to be made at high accuracy to prevent the remains of unfastened stitches which may cause loose thread in the knitting. This job demands a sort of skill thus causing a declination in the productivity.

For eliminating the foregoing disadvantage, the applicant of the present invention has previously introduced a method comprising the steps of: knitting surface knitted sections of jersey knit structure, fold-back knitted section of jersey knit structure, and overlap knitted sections of rib knit structure are knitted in succession with the use of arrays of knitting needles mounted on at least a pair of front and rear needle beds, one or both of which are arranged movable leftward and rightward; folding the fold-back knitted section over the back side of the surface knitted section along a boundary line extending between the fold-back section and the surface section; folding the overlap knitted section over the fold-back section along a boundary between the overlap section and the fold-back section so that the surface, fold-back, and overlap knitted sections are overlapped in "Z" form; and binding the uppermost ends of the triple-folded regions in pleats.

In common, the arrangement of pleats on a knitwear, e.g. a one-piece garment or a skirt, is essential for allowing a person who wears the knitwear to have a feeling of a close fit and to move more freely. The aforementioned method proposed by the same applicant provides each pleat arranged at an upper end in the "Z" or triple-folded form. Accordingly, when knitted with the use of a needle bed capable of traveling on a rack a 14-pitch distance at maximum, the pleat will be limited in the size to seven pitches-a half of the 14-pitch distance at each side due to its symmetrical shape.

The drawback thus resides in a fact that pleats larger than that size are hardly feasible allowing only a limited quality of fashionable knitwear to be served.

Also, the triple-folded regions become bulky and extending outward, thus providing a less fashionable appearance.

Furthermore, the upper end of the triple-folded regions provides less flexibility declining functional properties and ensuring less comfortableness in wear.

It is an object of the present invention, in view of the foregoing drawbacks, to provide a method of knitting in pleats, by which knitwears shaped in desired fashions and comfortable to wear can be fabricated without less productivity, and a knitted texture having knitted pleats.

SUMMARY OF THE INVENTION

A method of knitting pleats according to the present invention comprises the steps of: knitting surface knitted sections of jersey knit structure, fold-back knitted sections of jersey knit structure; and overlap knitted sections of rib knit structure in succession with the use of arrays of knitting needles mounted on at least a pair of front and rear needle beds, one or both of which are arranged movable leftward and rightward; removing the fold-back knitted sections from the corresponding needles after fastening of thread ends; displacing the surface knitted section and/or the overlap knitted section close to the needles, from which the fold-back knitted sections are removed, so that they are located next to each other; loading in succession of the surface, overlap, and surface knitted sections onto the array of needles on one of the two needle beds; after moving the other needle bed in a direction opposite to the fold-back direction of the fold-back section, loading the overlap or surface knitted section onto the knitting needles of the other needle bed; after moving the other needle bed in the knitting direction of the fold-back knitted section, overlapping the overlap section with the surface section through stitch shifting; and binding the overlapped regions in pleats. In a knitted structure having pleats knitted by the method of knitting set forth above, the overlap knitted section and the surface knitted section are overlapped.

It is now assumed that an array of knitting needles mounted on the front needle bed are termed front needles and an array of knitting needles mounted on the rear needle bed are termed rear needles. First, the surface knitted sections, the fold-back knitted sections, and the overlap knitted sections are knitted in succession.

The fold-back knitted sections are removed from the corresponding needles after fastening of thread ends by closed stitch knitting or thread ends are treated by thermal shrinkage thread fusing after the fold-back knitted sections are removed from the corresponding needles. Then, at least either the surface knitted section or the overlap knitted section is displaced so that the surface and overlap knitted sections are located next to each other.

The overlap knitted section is folded over the back side of surface section by displacing the end of the overlap section located next to the end of the surface section in an opposite direction and the two knitted sections are bound together at their uppermost end. Then, the fold-back knitted sections remain free at their upper end and the double-folded regions are formed in a less bulky arrangement thus maintaining flexibility.

BRIEF DESCRIPTION OF THE DRAWINGS

The accompanying drawings illustrate one embodiment of the present invention explaining an improved method of knitting in pleats and a knitted texture having knitted pleats, in which.

DESCRIPTION OF THE PREFERRED EMBODIMENT

One preferred embodiment of the present invention will now be described referring to the accompanying drawings.

A knitting machine eligible for this embodiment is of a transverse knitting type having a pair of front and rear needle beds (not shown) arranged in parallel to each other in a V-form in a side view and with their upper ends spaced closer close together. Each of the needle beds has at the top, a multiplicity knitting needles mounted in a line for forward and backward sliding motion with the bed. The rear needle bed is arranged for lengthwise racking movement through a distance of seven gages.

Figure 1:
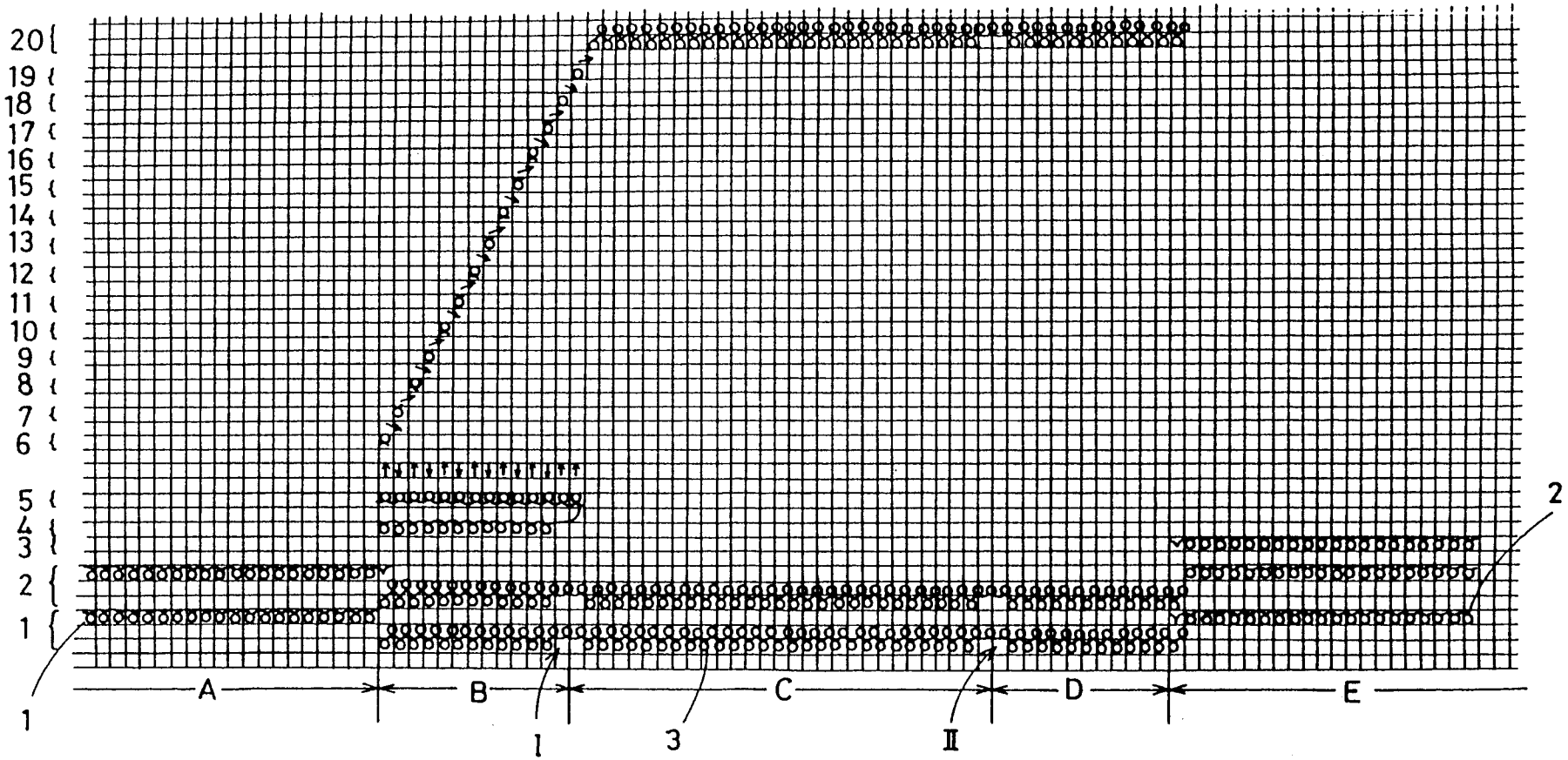
FIG. 1 is a diagram showing a group of courses for forming a box pleat from the start of knitting a surface knitted section A to its closed stitch process.

FIG. 1 illustrates the arrangement of primary knitting courses for forming box pleats, in which the vertical axis represents successive courses and the horizontal axis exhibits a series of loops in knitting.

The lower-half of each course carries a series of loops of thread interlooped with the knitting needles of the front needle bed (referred to as front knitting needles hereinafter) and the upper-half carries a series of loops interlooped with the knitting needles of the rear needle bed (referred to as rear knitting needles).

As shown, each of the courses 1, 2, and 3 consis of a surface knitted section A of fabricated with the front knitting needles, a fold-back knitted section B of elastic form fabricated with the front and rear knitting needles, an overlap knitted section C of elastic form, another fold-back knitted section D of elastic form, and another surface knitted section E of sheeting form. The knitted sections are knitted with threads 1, 2, and 3, which are fed from their respective carriers, not shown, by action of the front and rear knitting needles controlled with a carriage (not shown). Another series of loops are formed successively to the surface knitted section E in course 3. Also, the knitted sections are tacked at ends to one another with the threads 1, 2 and 3.

Two junctions I and II between the fold-back sections B and D and the overlap section C are knitted by knitting needles on one of the two needle beds for ease of making creases.

At the courses 4 and 5, new threads are supplied to the front needle bed and the rear needle bed, respectively, so that the loops of the rib knitting fold-back section B are divided into two series of loops.

At the courses 6 through 20, the loops on the knitting needles are bound off and removed from the knitting needles one by one. For example, first the loop on one of the front knitting needles is transferred to one of the rear knitting needles and overlaps the loop on the rear knitting needle at an end of the rib knitting fold-back section B. Next, a new thread is supplied to the rear knitting needle holding to two overlapped loops and a new loop is formed. The new loop is transferred to another front knitting needle next to the above said front knitting needle and as a result, the two overlapped loops are bound off and removed from the rear knitting needle.

Figure 2:
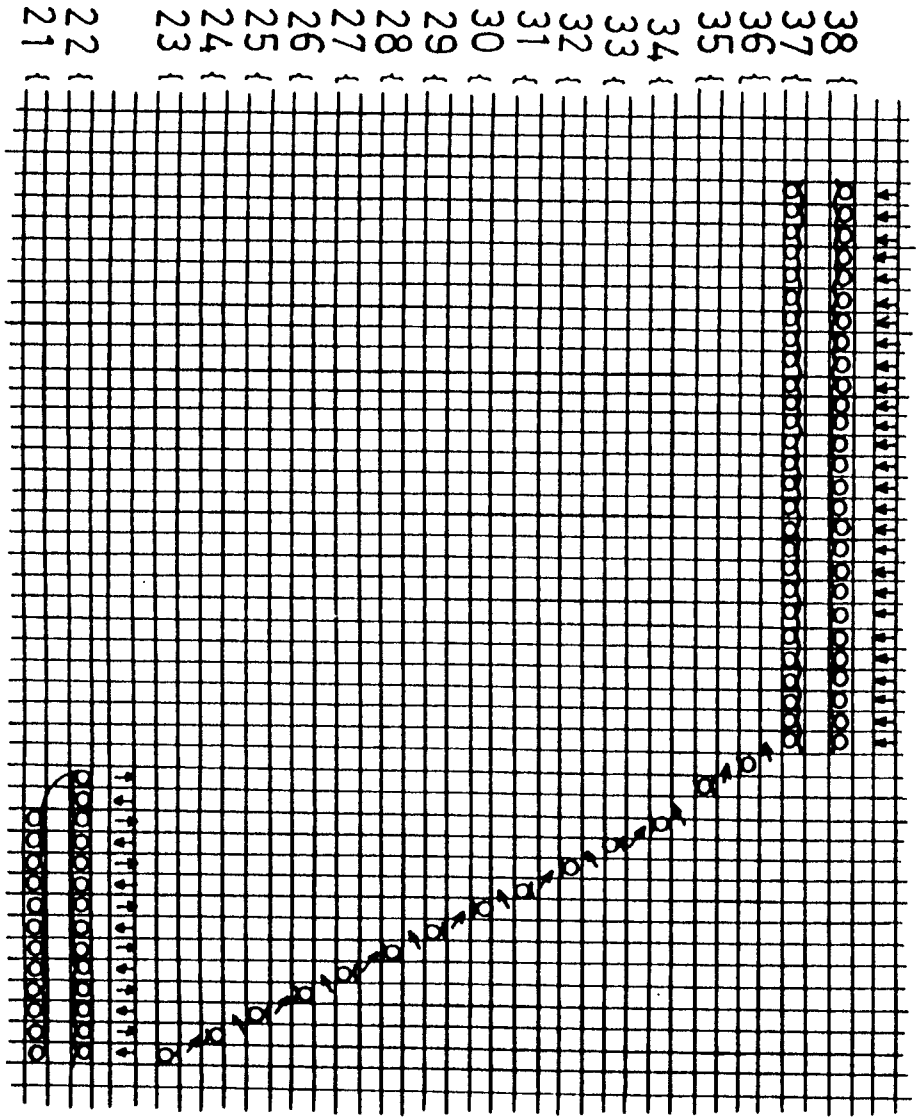
FIG. 2 is a diagram showing a group of courses for closing a surface knitted section E.

Also, the series of the thread loops of the elastic fold-back knitted section D provided in the right, like the fold-back section B in the left, are divided into two sections on the front and rear knitting needles respectively at the courses 21 and 22, as shown in FIG. 2.

Similarly, the successive loops of the section D are closed and removed one by one from their respective needles during the courses 23 to 36.

As the shift of looped stitches is carried out threads with which the knitted sections are knitted may be worn thin according to a type of knitting yarn as the shift of looped stitches is carried out throughout the foregoing courses. If the thrads in the overlap section C are found to be worn, additional loops are formed at the courses 37 and 38 and then, new loops are added to the loops transferred from the rear needles to the front needles at the course 39.

If the threads in the surface knitted section A are found to be worn thin, additional loops are formed at the courses 40–41, and if the threads in the surface knitted section E are found to be worn thin, additional loops are formed at the courses 41–42.

As both the elastic fold-back knitted sections B and D in the left and right respectively have been closed and removed, their corresponding knitting needles situated on the left and right sides of the overlap knitted section C now carry no loops of thread.

Figure 3:
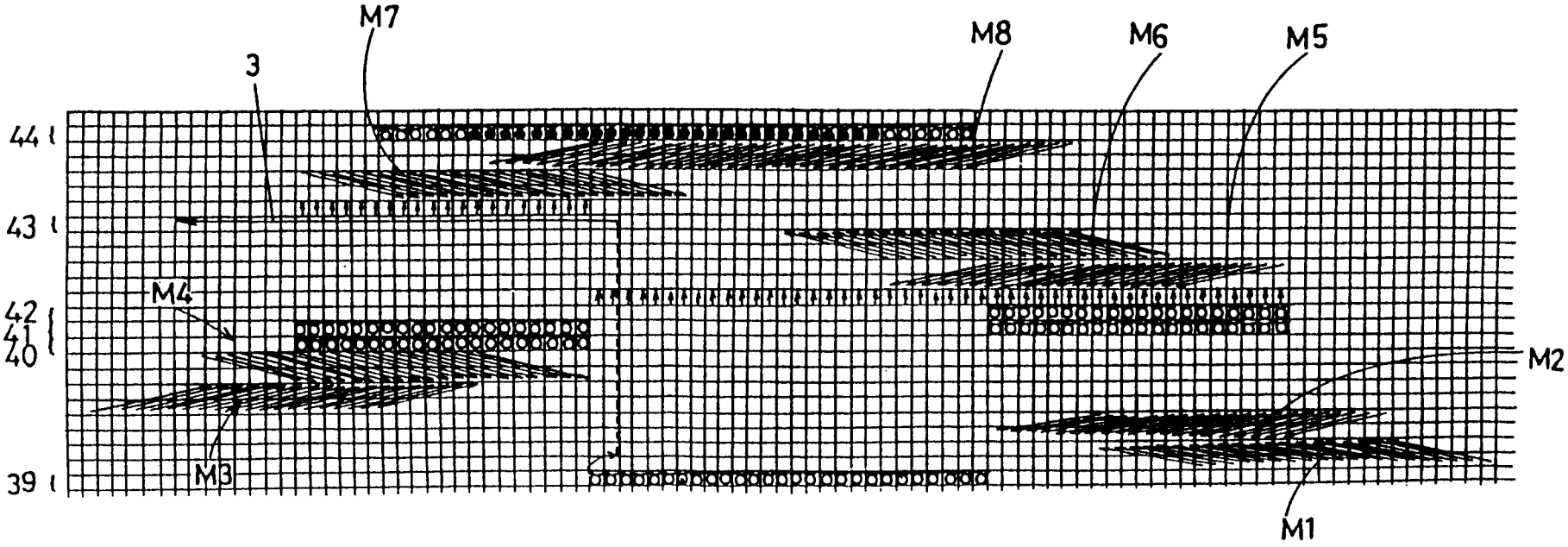
FIG. 3 is a diagram showing the transfer of knitted sections for forming the box pleat.
Figure 4:
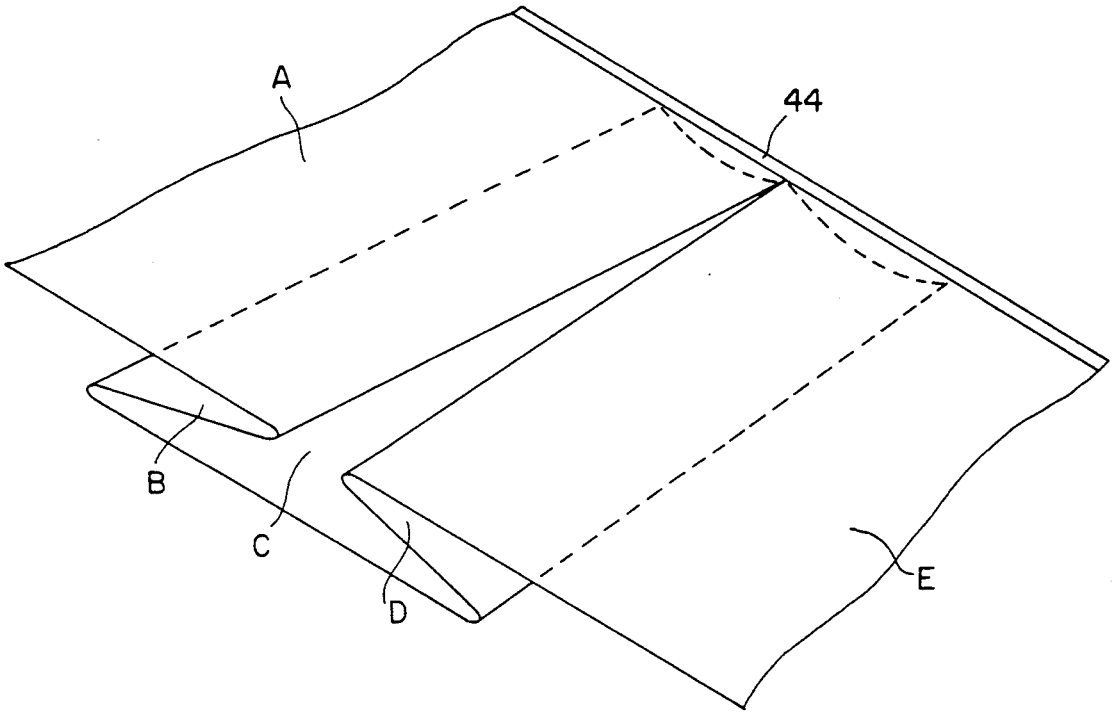
FIG. 4 illustrates a folded skirt illustrating the knitted sections A–E.

The two surface knitted sections A and E of a jersey knit structure are transferred and loaded onto the foregoing knitting needles beside the overlap section C during the courses 39 to 40, as shown in FIG. 3.

The transfer of the two surface sections A and E from a group of needles to another group will then be described.

For transferring the surface knitted section E, it starts with the rear needle bed moving on a rack from the original position to the right limit (by seven pitches because the knitting machine permits travel of a seven gage distance) while the loops of thread of the surface knitted section E remain loaded on the front needles. Then, the successive loops of the surface knitted section E are transferred from the front needles onto the rear needles. When the rear needle bed has been returned back to the original position, the loops of the surface knitted section E are displaced seven pitches to the left as denoted by the arrows $M_1$ in FIG. 3.

In sequence, the rear needle bed is moved again from the original position by seven pitches to the left. As the loops of thread are transferred from the rear needles to the front needles, the surface knitted section E is further displaced by seven pitches to the left as denoted by the arrows $M_2$. As the result, the surface knitted section E is displaced a distance of 14 pitches leftward from the original position at the course 2 and stays with its left end located next to the right end of the overlap knitted section C.

For dislocating the surface knitted section A, it starts with the rear needle bed moving on a rack from the original position to the left limit (by seven pitches) while the successive loops of the surface knitted section E remain held on the front needles. Then, the successive loops of the surface knitted section E are transferred from the front needles onto the target rear needles. When the rear needle bed has been returned back to the original position, the loops of the surface knitted section A are displaced seven pitches to the right as denoted by the arrows $M_3$ in FIG. 3.

Similarly, the rear needle bed is moved again from the original position by seven pitches to the right. As the loops of thread are transferred from the rear needles to the front needles, the surface knitted section A is further displaced by seven pitches to the left as denoted by the arrows $M_4$. As the result, the surface knitted section A is displaced a distance of 14 pitches rightward from the original position at the course 2 and stays with its right end located next to the left end of the overlap section C.

Prior to the course 43 where the thread 3 for knitting the overlap section C is removed from the corresponding needles, the surface knitted section E is shifted leftward for forming the right half of a box pleat and the surface knitted section A is shifted rightward for forming the left half of the same.

The successive loops of both the overlap section C and the surface section E are transferred from the front needles to the rear needles before the leftward displacement of the surface section E and after the course 42.

Then, the rear needle bed is moved on a rack by seven pitches from the original position to the left and the loops of the surface section E are transferred from their respective rear needles to the front needles. When the rear needle bed has been returned back to the original position, the loops of the surface section E are displaced seven pitches to the left as denoted by the arrows $M_5$.

Furthermore, the rear needle bed is moved by seven pitches from the original position to the right and then, returned to the left by seven pitches. When the loops of the surface section E held on their respective front needles have been transferred back to the rear needles, the surface knitted section E is displaced seven pitches more to the left as denoted by the arrows $M_6$. Accordingly, the surface knitted section E is overlapped with the right half of the overlap knitted section C forming the right half of a box pleat.

For forming the left half of the box pleat, it starts with the rear needle bed moving on a rack by seven pitches from the original position to the left. Then, the loops of the surface knitted section A are transferred to the rear needles as followed by transferring back to the front needles after the returning of the rear needle bed to the start position. Accordingly, the surface knitted section A is displaced seven pitches to the right as denoted by the arrows $M_7$.

Then, after the rear needle bed is moved leftward by seven pitches, the successive loops of both the overlap section C and the surface section E are transferred from the rear needles to the front needles. The two section C and E are now displaced by a distance of seven pitches in the overlap relationship as denoted by the arrows $M_8$. As a new series of loops are formed at the course 44, the box pleat of closely knitted texture is completed with its two, left and right, 14-pitch deep pockets extending in symmetry. Consequently, after the course 44, a desired number of courses are knitted and the end of the knitted fabric is treated by a known method.

Although the fold-back knitted sections B and D of a rib knit structure have there uppermost ends not suspended, they will cause no declination in the quality and fitness.

It is understood that any one or both of the two, front and rear, needle beds of the transverse-type knitting machine, cf. the rear bed is arranged movable in the embodiment, can be arranged for transverse movement for the purpose.

Although the knitting machine in the embodiment has one pair of the confronting needle beds, it may have two or more pairs for successfully achieving the object of the present invention. It is also understood that the method of the present invention is applicable to form common pleats other than the box pleats.

Although the uppermost ends of the fold-back knitted sections B and D are finished with closed stitches, they may be fastened not to came loose with the use of thermal shrinkage thread woven into the knitted texture and fused by heat.

Also, the knitting arrangement of the embodiment in which the fold-back and overlap sections B, D, and C are knitted in a rib knit structure and the surface section A and E are knitted in a jersey knit structure may be altered or modified as desired.

What is claimed is:

1. A method of knitting pleats in knitwear comprising the steps of: knitting surface knitted sections of jersey knit structure, fold-back knitted section of jersey knit structure, and overlap knitted sections of rib knit structure in succession with knitting needles mounted on at least a pair of front and rear needle beds of a flat bed knitting machine, binding off loops that form ends of the fold-back knitted sections one-by-one in order to remove the fold-back knitted sections from the knitting needles; removing the fold back knitted sections from the knitting needles, fastening the loops that form ends of the fold-back knitted sections after removing the loops from the knitting needles; transferring only the surface knitted sections to vacant needles from which the fold-back knitted sections were previously removed, so that the ends of the surface knitted sections and the overlap knitted sections are located adjacent to each other; loading in succession the overlap and surface knitted sections onto needles on one of the two needle beds; racking the other needle bed in one direction so that the surface knitted sections and the overlap knitted sections are spaced apart; loading either the overlap knitted sections or one of the surface knitted sections on the knitting needles of the other needle bed; racking the other needle bed in the opposite direction so that one of the surface knitted sections and the overlap knitted sections form overlapping regions; transferring the loops at the end of the overlap knitted sections to the knitting needles holding the loops at the end of the surface knitted sections; and binding the overlapped regions in pleats.

2. A method of knitting pleats in knitwear comprising the steps of: knitting surface knitted sections of jersey knit structure, fold-back knitted sections of jersey knit structure, and overlap knitted sections of rib knit structure in succession with knitting needles mounted on at least a pair of front and rear needle beds of a flat bed knitting machine, binding off loops that form ends of the fold-back knitted sections one-by-one in order to remove the fold-back knitted sections from the knitting needles; removing the fold back knitted sections from the knitting needles, fastening the loops that form ends of the fold-back knitted sections after removing the loops from the knitting needles; transferring the overlap knitted sections to vacant needles from which the fold-back knitted sections were previously removed, so that the ends of the surface knitted sections and the overlap knitted sections are located close to each other; loading in succession the overlap and surface knitted sections onto needles on one of the two needle beds; racking the other needle bed in one direction so that the surface knitted sections and the overlap knitted sections are spaced apart, loading either the overlap knitted sections or one of the surface knitted sections on the knitting needles of the other needle bed; racking the other needle bed in the opposite direction so that one of the surface knitted sections and the overlap knitted sections form overlapping regions; transferring the loops at the end of the overlap knitted sections to the knitting needles holding the loops at the end of the surface knitted sections, and binding the overlapped regions in pleats.

3. A method of knitting pleats in knitwear comprising the steps of: knitting surface knitted sections of jersey knit structure, fold-back knitted sections of jersey knit structure, and overlap knitted sections of rib knit structure in succession with knitting needles mounted on at least a pair of front and rear needle beds of a flat bed knitting machine, binding off loops that form ends of the fold-back knitted sections one-by-one in order to remove the fold-back knitted sections from the knitting needles; removing the fold back knitted sections from the knitting needles, fastening the loops that form ends of the fold-back knitted sections after removing the loops from the knitting needles; transferring the surface knitted sections and overlap knitted sections to vacant needles from which the fold-back knitted sections were previously removed, so that the ends of the surface knitted sections and the overlap knitted sections are located adjacent to each other; loading in succession the overlap and surface knitted sections onto needles on one of the two needle beds; racking the other needle bed in one direction so that the surface knitted sections and the overlap knitted section are spaced apart; loading either the overlap knitted sections or one of the surface knitted sections on the knitting needles of the other needle bed; racking the other needle bed in the opposite direction so that one of the surface knitted sections and the overlap knitted sections form overlapping regions; transferring the loops at the end of the overlap knitted sections to the knitting needles holding the loops at the end of the surface knitted sections; and binding the overlapped regions in pleats.

* * * * *